US005397131A

United States Patent [19]

Kraemer

[11] Patent Number: 5,397,131

[45] Date of Patent: Mar. 14, 1995

[54] YARD CASTING ASSEMBLY

[76] Inventor: Sandy F. Kraemer, 2402 Ceresa La., Colorado Springs, Colo. 80909

[21] Appl. No.: 158,280

[22] Filed: Nov. 29, 1993

[51] Int. Cl.[6] ..... A63B 67/10; A63B 69/00

[52] U.S. Cl. ..... 273/350; 273/140

[58] Field of Search ..... 273/140, 348, 350

[56] References Cited

U.S. PATENT DOCUMENTS

| | | | |
|---|---|---|---|
| 420,149 | 1/1890 | Elson | 273/140 |
| 1,456,308 | 5/1923 | Haigh | 273/140 |
| 1,551,685 | 9/1925 | O'Brien | 273/140 |
| 2,146,194 | 2/1939 | Rubens et al. | 273/140 |
| 2,598,487 | 5/1952 | Anechiarico | 273/140 X |
| 2,611,617 | 9/1952 | Strohm | 273/140 |
| 2,703,469 | 3/1955 | Raizen | 273/140 X |
| 3,463,494 | 8/1969 | Stroh | 273/345 |
| 3,788,641 | 1/1974 | Lemelson | 273/140 |
| 4,364,570 | 12/1982 | Hallam | 273/407 X |
| 4,976,439 | 12/1990 | Kraemer | 273/140 X |

*Primary Examiner*—William H. Grieb
*Attorney, Agent, or Firm*—Phillip A. Rein

[57] ABSTRACT

This invention relates to an improved yard casting assembly having a game target assembly and a casting lure assembly connectable to a fishing line on a casting rod and reel assembly for casting outwardly to engage the game target assembly. The game target assembly can resemble fish structures, an octopus, wild animals, or other structures of various shapes and includes a main base assembly having a lure connector member connected thereto. The casting lure assembly is provided with a main lure body member having a lure skirt member connected thereto. The main lure body member is provided with an intermediate target connector section having a slot portion operable to receive and hold the lure connector member of the game target assembly therein in a successful casting operation.

16 Claims, 3 Drawing Sheets

YARD CASTING ASSEMBLY

PRIOR ART

The applicant herein has obtained a U.S. Pat. No. 4,976,439, entitled "Yard Casting Assembly", issued on Dec. 11, 1990, inventor Sandy F. Kraemer. This is probably the most pertinent prior art reference to this application.

A patent search on applicant's subject issued patent revealed the following United States patents:

| U.S. Pat. No. | Invention | Inventor |
|---|---|---|
| 420,149 | GAME APPARATUS | James Elson |
| 1,456,308 | APPLIANCE FOR PLAYING | William C. Haigh |
| 1,551,685 | GAME | Peter T. O'Brien |
| 2,146,194 | GAME DEVICE | H.A. Rubens et al |
| 2,598,487 | FISHING GAME | Louis J. Anechiarico |
| 2,611,617 | FISHING GAME | Edward J. Strohm |
| 2,703,469 | TOY FISH | Charles S. Raizen |
| 3,463,494 | PRACTICE DEVICE FOR CATCHING FISH | Patricia A. Stroh |
| 3,788,641 | MANIPULATION GAME | Jerome H. Lemelson |
| 4,364,570 | ROPING TRAINING AID | Delbert W. Hallam |

The Elson, Haigh, O'Brien, and Rubens et al patents disclose numerous types of fish game structures utilizing a plurality of fish members having an eyelet thereon adapted to be grasped by a hook member connected to a line connected to a fishing pole.

The Anechiarico patent discloses a fishing game utilizing a rod and reel structure and a plurality of various types of fish members. This fishing game utilizes either a hook and eye structure attached to a mouth portion of the respective fish members or magnetic blocks.

The Strohm patent discloses a fishing game having a card with a fish member thereon and a pair of prongs which are to be grasped by a ring attached to a fishing line and pole.

The Raizen patent discloses a toy fish having an upright fin member which can be mounted on a support ground or in the water and utilizes a fish hook to catch the toy fish.

The Stroh patent discloses a practice device for catching fish and utilizes an operator with a rod and reel casting a fishing line having a first member on an outer end thereof. The fishing line with the first member attached thereto is casted to place same into a trough-like structure and the magnetic attraction thereof allows the pieces to be joined together as noted in FIG. 4.

The Lemelson patent discloses a game structure utilizing numbered fish structures each having a fin member and utilizing Velcro connectors.

The Hallam patent discloses a rope training aid which basically teaches a pair of spaced horns to which a rope, similar to a fishing line, is tossed. In this case, the rope is placed about the horns and, thus, dissimilar in operation relative to applicant's invention.

PREFERRED EMBODIMENT OF THE INVENTION

In one preferred embodiment of this invention, an improved yard casting assembly is operable to be utilized in combination with a game operator having a casting rod and reel assembly operable as a game structure and as a means of improving the skills of a fisherman in the area of fly casting and fishing with lures. The casting rod and reel assembly is a standard rod member having a reel member thereon with a fishing line which is attached at an outer end thereof to a portion of the improved yard casting assembly of this invention. The improved yard casting assembly includes 1) a game target assembly to be placed on a ground support surface; and 2) a casting lure assembly connected to the fishing line operable to be casted toward the game target assembly during a method of game play.

The game target assembly includes a main base assembly having a lure connector member connected thereto. The main base member can be of various shapes, such as resembling the outline of a fish member or an octopus, to be supported on an underside on the ground support surface such as a grassy surface. The main base member includes a central section having laterally extended support fins to add vertical stability when the game target assembly is being reeled in by the casting rod and reel assembly.

The lure connector member is a J-shaped hook section connected to and extended forwardly from a forward section of the main base assembly.

The casting lure member includes a main lure body member having a lure skirt member connected thereto. The main lure body member includes a forward line connector section integral with an intermediate target connector section which, in turn, is integral with a rear skirt connector section.

The forward line connector section is of conical shape and having an anchor hole for connection to the fishing line.

The intermediate target connector section has a slot portion operable to receive and releasably connect to the lure connector member on the game target assembly during a casting operation in the method of game play as will be described.

The rear skirt connector section is provided with a skirt connector groove portion operable to releasably receive one of various types and colors of lure skirt members therein.

Each lure skirt member is provided with a main connector ring having a plurality of trailing lure fingers secured thereto. The main connector ring has a central opening operable to be releasably mounted within the skirt connector groove portion of the rear skirt connector section of the main lure body member. Each lure skirt member is preferably constructed of a resultant, flexible material for ease of mounting in and removing from the skirt connector groove portion plus resembling movement of a conventional fishing lure on the ground support surface.

It is noted that the improved yard casting assembly of this invention can be utilized 1) as a recreational game structure whereupon points can be awarded for retrieving of the game target assembly on a certain number of casting tries; and 2) to provide a casting game target assembly so as to improve the casting skills of a fisherman.

OBJECTS OF THE INVENTION

One object of this invention is to provide an improved yard casting assembly to be used by a game operator using a casting rod and reel assembly and includes a casting lure assembly secured to a fishing line for casting the lure assembly toward a game target assembly which is provided with a lure connector member engagable and connectable with the casting lure assembly for subsequent retrieving of the game target assembly as a recreational game structure.

Another object of this invention is to provide an improved yard casting assembly including 1) a game target assembly resembling a fish or octopus structure; and 2) a casting lure assembly attachable to an outer end of a fishing line connected to a casting rod and reel assembly whereupon the casting lure assembly is thrust outwardly in an attempt to be engaged in a wedged action with a lure connector member on the game target assembly in order to improve the casting skills of the user thereof.

One other object of this invention is to provide an improved yard casting assembly including a game target assembly resembling a fish member having a forward section simulating a fish head with a forwardly projecting lure connector member operable to engage and connect to the casting lure assembly during a fish lure casting operation.

An additional object of this invention is to provide an improved yard casting assembly including a casting lure assembly having 1) a forward connector section to be connected to a fishing line; 2) an intermediate target connector section to be releasably connected to the lure connector member on the game target assembly; and 3) a rear skirt connector groove portion to receive and support a lure skirt member thereon.

One further object of this invention is to provide an improved yard casting assembly including a game target assembly resembling a fish structure and having a casting lure assembly releasably connected to the game target assembly for retrieving the game target assembly and which has a lower support surface and laterally extended support fins which create a wiggling movement to the game target assembly on retrieving same.

One further object of this invention is to provide an improved yard casting assembly including a game target assembly resembling an octopus structure with a plurality of laterally extended support legs, each having a line connector member secured thereto.

Still, one other object of this invention is to provide an improved yard casting assembly which is attractive in appearance; economical to manufacture; easy to use; substantially maintenance free; and providing entertainment and/or a casting skill improvement device to a user thereof.

Various other objects, advantages, and features of the invention will become apparent to those skilled in the art from the following discussion, taken in conjunction with the accompanying drawings, in which:

FIGURES OF THE INVENTION

Figure 1:
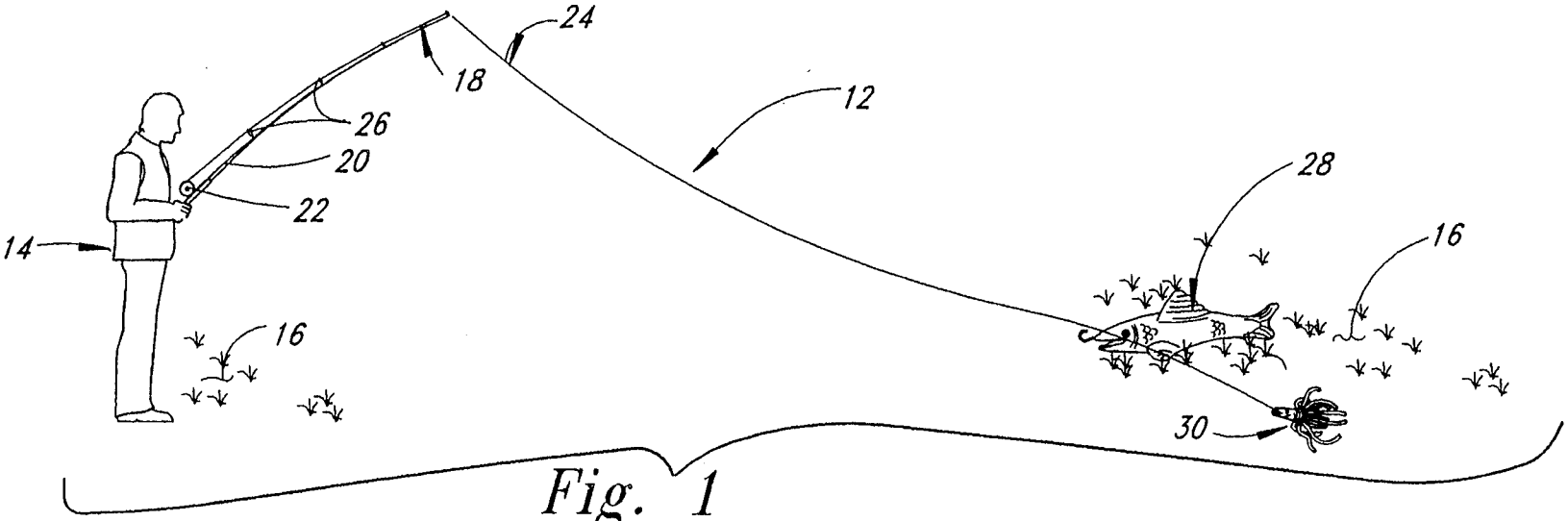
FIG. 1 illustrates a game operator utilizing a rod and reel assembly with an improved yard casting assembly of this invention in a casting operation.

The following is a discussion and description of preferred specific embodiments of the improved yard casting assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail, and in particular to FIG. 1, an improved yard casting assembly of this invention, indicated generally at 12, is shown in FIG. 1 being utilized by a game operator 14 standing on a ground support surface 16 and holding a casting rod and reel assembly 18. The casting rod and reel assembly 18 includes a rod member 20 having a reel member 22 mounted thereon which, in turn, has a fishing line 24 wound thereon in a conventional manner. The rod member 20 is provided with a plurality of spaced eyelets 26 to receive the fishing line 24 therethrough which is normally attached to a fishing lure, fly, or bait for utilization in a fishing endeavor. The game operator 14 can be using the improved yard casting assembly 12 as a game structure or to increase rod and reel casting skills for future use as a fisherman.

The improved yard casting assembly 12 includes 1) a game target assembly 28 which can be mounted on the ground support surface 16 being spaced from the game operator 14; and 2) a casting lure assembly 30 which is connected to an outer end of the fishing line 24 for use as will be explained.

Figure 2:
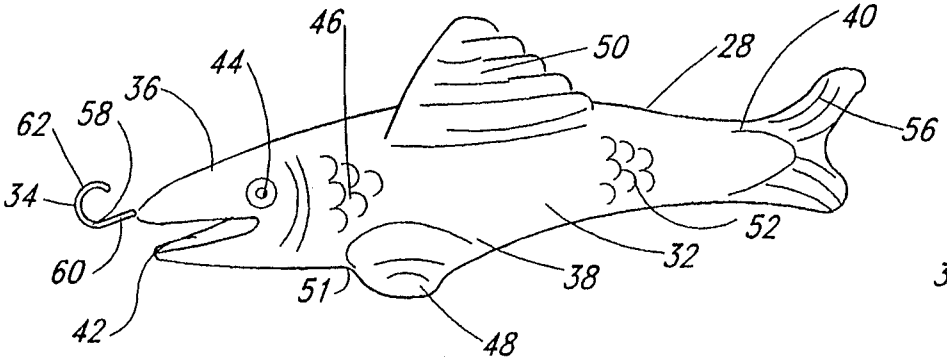
FIG. 2 is a perspective view of a game target assembly of the improved yard casting assembly of this invention.

As noted in FIG. 2, the game target assembly 28 includes a main base assembly 32 of a generally fish shape outline having a lure connector member 34 secured to a forward portion thereof. The main base assembly 32 includes a forward section 36 integral with a central section 38 which, in turn, is integral with a rear section 40. The forward section 36 includes a mouth portion 42, an eye portion 44, and a cheek portion 46.

The central section 38 is provided with opposed lateral support fins, pelvic fins, or support member 48 operable to engage the ground support surface 16 or grass on a support surface 51 during movement thereupon to cause a wiggling or transverse motion of the entire game target assembly 28 when being retrieved. Further, the central section 38 includes a vertical top fin or dorsal fin 50.

The rear section 40 is provided with a scale portion 52 and a tail fin or caudal fin 56.

The lure connector member 34 is of a generally J-shape with a hook section 58 having a connector portion 60 secured at one end to the mouth portion 42 of the main base assembly 32 and integral at an opposite end with a circular lure connector portion 62.

Figure 5:
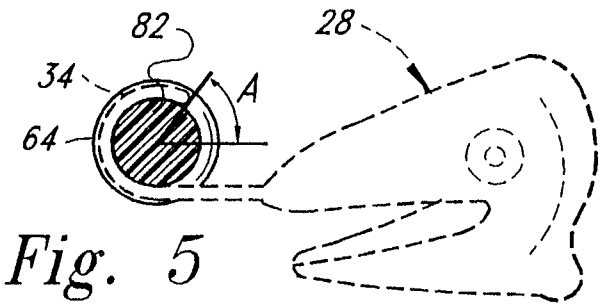
FIG. 5 is a sectional view taken along line 5—5 in FIG. 4.

The lure connector member 34 is constructed of a rod material being circular in transverse cross section. The lure connector portion 62 is of a circular shape extended beyond 150 degrees leaving an open portion A (FIG. 5) for reasons to be explained.

Figure 4:
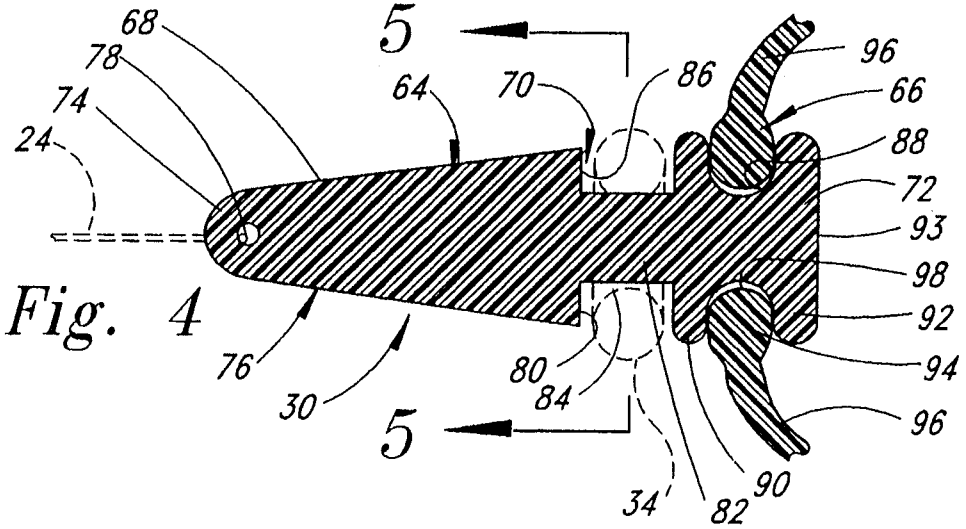
FIG. 4 is an enlarged sectional view taken along line 4—4 in FIG. 3.

As noted in FIG. 4, the casting lure assembly 30 includes a main lure body member 64 having a lure skirt member 66 releasably mounted thereon. The main lure body member 64 includes a forward lure connector section 68 integral with an intermediate target connector section 70 which, in turn, is integral with a rear skirt connector section 72.

The forward lure connector section 68 is of a conical shape including 1) a spherical head portion 74; 2) a tapered side wall portion 76; and 3) an anchor hole 78 for attachment of the fishing line 24 thereto.

The intermediate target connector section 70 includes a slot portion 80 about a central support portion 82. The central support portion 82 is defined by a cylindrical inner wall 84 and adjacent parallel side walls 86.

The rear skirt connector section 72 includes a skirt connector groove portion 88 defined between a forward retainer portion 90 and a rearward retainer portion 92 formed with an outer end wall surface 93. The skirt connector groove portion 88 is of a semi-circular shape in transverse cross section (FIG. 5) for reasons to be explained.

The lure skirt member 66 is preferably constructed of a flexible, resilient material for irregular movement during use and connecting to the main lure body member 64. The lure skirt member 66 includes a main support and connector ring 94 having a plurality of trailing lure fingers 96 connected thereto.

The main support and connector ring 94 has a central opening 98 operable to be held and releasably mounted in the skirt connector groove portion 88 in the main lure body member 64 as noted in FIG. 4. The resilient nature of the main support and connector ring 94 holds it in the skirt connector groove portion 88.

Figure 3:
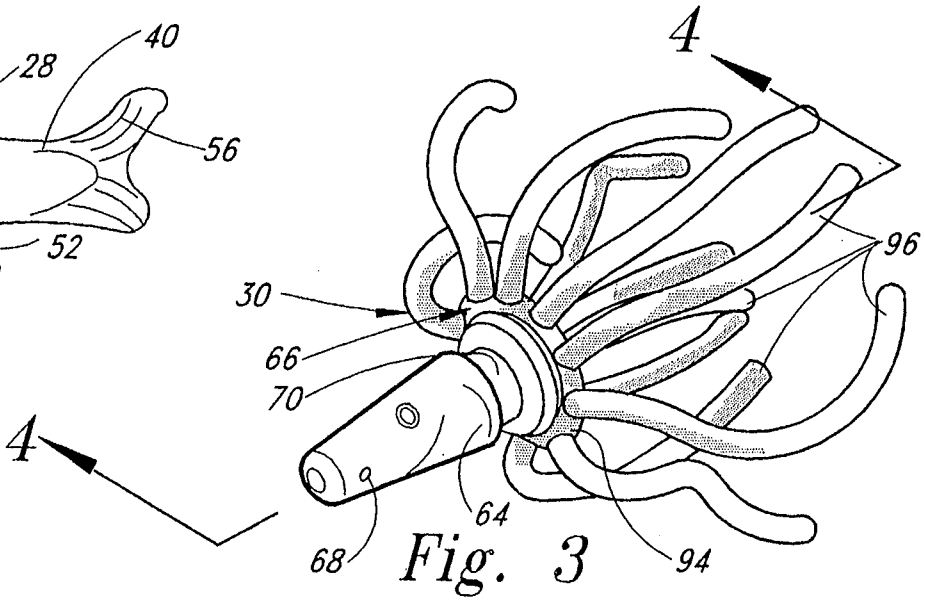
FIG. 3 is a perspective view of a casting lure assembly of the improved yard casting assembly of this invention.

As shown in FIG. 3, the trailing lure fingers 96 each include 1) a ring connector section anchored to the main support and connector ring 94; and 2) a flexible intermediate section having one end integral with the ring connector section and an opposite end integral with an outer end section.

The casting lure assembly 30 is preferably constructed of a resilient rubber or plastic material having a desired weight for casting plus being resiliently engagable with the lure connector member 34 on the game target assembly 28 for a connecting and retrieving operation as will be explained.

Figure 8:
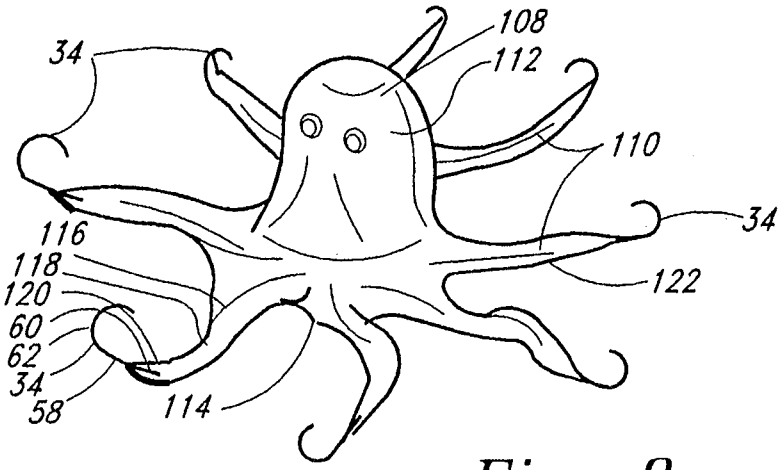
FIG. 8 is a perspective view of a second embodiment of the game target assembly.

In a second embodiment of this invention as noted in FIG. 8, a multiple hook game target assembly 106 is provided resembling an octopus structure including 1) a main body member 108; 2) a plurality of lateral support legs 110 secured to the main body member 108; and 3) a lure connector member 34 connected to an outer end of each lateral support leg 110. The main body member 108 is provided with a central head section 112 having a lower support surface 114.

Each lateral support leg 110 includes 1) an inner connector portion 116 secured to the central head section 112; 2) an intermediate support portion 118 integral at one end with an outer end of the inner connector portion 116; and 3) an outer end of the intermediate support portion 118 integral with an outer connector portion 120.

Each lateral support leg 110 has a lower support surface 122 in a common plane with the lower surface 114 of the main body member 108 for reasons to be explained.

The lure connector members 34 are identical to that described in the game target assembly 28 in the first embodiment. The J-shaped hook section 58 has the circular lure connector portion 62 extended in a plane perpendicular to respective ones of the lower support surface 122 of the lateral support legs 110.

Both the game target assembly 28 and the multiple hook game target assembly 106 may be constructed of a buoyant material so as to be floatable in a body of water when used in the method of game play of this invention. Also, the game target assembly 28 and the multiple hook game target assembly 106 are constructed to automatically position in an upright condition when thrown into a body of water.

USE AND OPERATION OF THE INVENTION

In the use and operation of the improved yard casting assembly 12 of this invention, it is noted that the game target assembly 28 and the multiple hook game target assembly 106 can be constructed to resemble different fish species such as a shark, a catfish, or a bass (even animal species or others). A plurality of the game target assemblies 28, 106 can be provided so as to provide either a game of practice for a fisherman or a game structure for an overall method of game play.

As noted in FIG. 1, the game target assembly 28 is placed outwardly away from the game operator 14 and mounted on the ground support surface 16 which may be a grassy area or a water surface such as a lake, pond, or swimming pool.

Figure 6:
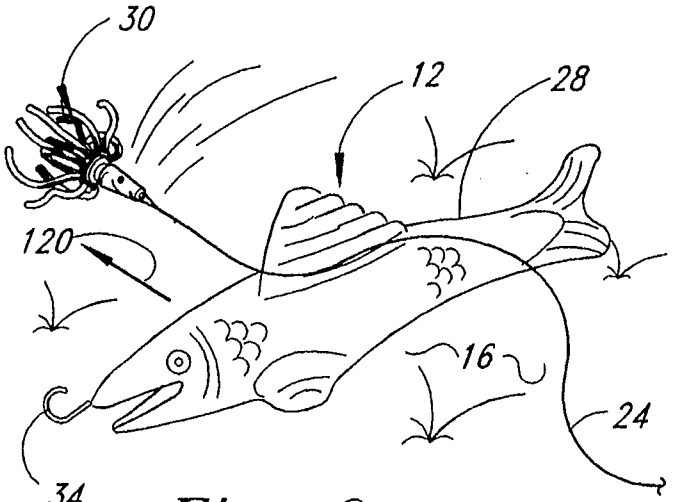
FIGS. 6 and 7 are perspective views illustrating use of the improved yard casting assembly during a method of game play.

Next, the game operator 14 attaches the casting lure assembly 30 to an outer end of the fishing line 24 and retrieves subject fishing line 24 within the reel member 22 after a casting operation. Thereupon, the game operator 14, in a conventional manner, casts the casting lure assembly 30 outwardly to the position shown in FIG. 1 and indicated by an arrow 126 in FIG. 6.

Then, the fishing line 24 can be retrieved by the game operator 14 through conventional operation of the reel member 22. The object of the improved yard casting assembly 12 is to retrieve the fishing line 24 between the inner confines of the lure connector portion 62 of the lure connector member 34 as shown in FIGS. 1 and 7.

Figure 7:
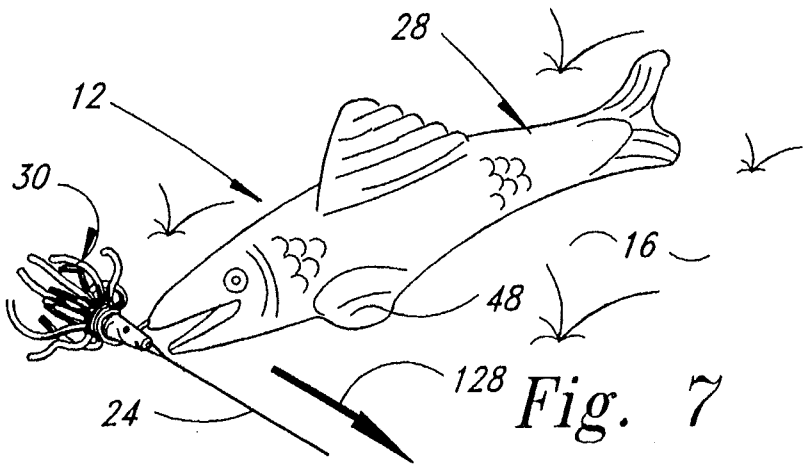

On achieving placement of the casting lure assembly 30 and fishing line 24 in close proximity to the lure connector member 34, the fishing line 24 is retrieved as noted by an arrow 128 in FIG. 7. The fishing line 24 would move down an upper surface of the main base assembly 32 to be within the confines of the circular lure connector portion 62. Further retrieving of the fishing line 24 will pull the spherical head portion 74 of the main lure body member 64 through the circular lure connector portion 62 to the interconnected position as noted in FIGS. 4, 5, and 7.

Due to the resilient nature of the main lure body member 64, the tapered side wall portion 76 compresses and the lure connector member 34 snaps into the slot portion 80 of the intermediate target connector section 70 of the casting lure assembly 30. As the distance "A" is less than the diameter of the central support portion 82, the casting lure assembly 30 will be firmly and positively held within the slot portion 80.

The game operator 14 then uses the reel member 22 to retrieve the fishing line 24 and interconnected casting lure assembly 30 and the game target assemblies 28 or 106.

The use and operation of the second embodiment using the multiple hook game target assembly 106 is the same as described above for the first embodiment except a plurality of laterally extended line connector members 34 on individual lateral support legs 110 are provided.

The improved yard casting assembly embodiments of this invention can be used as targets during bass fishing tournaments in tests of skill to replace the present use of floating rings.

The improved yard casting assembly can be utilized either as a game structure having a method of game play or by a fisherman in order to practice and improve his casting skills for later use in a body of water in a fishing operation.

The improved yard casting assembly of this invention is easy to use; economical to manufacture; substantially maintenance fee; and provides a great amount of entertainment and/or practice for improving fishing skills.

While the invention has been described in conjunction with preferred specific embodiments thereof, it will be understood that this description is intended to illustrate and not to limit the scope of the invention, which is defined by the following claims:

I claim:

1. An improved yard casting assembly operable with a casting rod and reel assembly having a fishing line, comprising:

a) a game target assembly having a lure connector member mounted thereon and projected forwardly therefrom;

b) a casting lure assembly connectable to the fishing line and engagable with said lure connector member in a locking action;

c) said casting lure assembly includes a main lure body member having a lure skirt member mounted thereon;

d) said main lure body member includes a forward line connector section integral with a target connector section which, in turn, is integral with a skirt connector section; and e) said target connector section includes a slot portion to receive said lure connector member therein in a locked condition on retrieving the fishing line, said casting lure assembly, and said game target assembly.

whereby a game operator of the casting rod and reel assembly can retrieve the fishing line and interconnected said casting lure assembly so as to engage said lure connector member and move said game target assembly to the game operator to simulate a fish catching operation.

2. An improved yard casting assembly as described in claim 1, wherein:

a) said line connector section secured to the fishing line at a forward head portion and being of a cone shape tapering rearwardly and outwardly from said head portion for ease of movement into said lure connector member during a casting operation.

3. An improved yard casting assembly as described in claim 1, wherein:

a) said skirt connector section includes a skirt connector groove portion operable to receive said lure skirt member releasably mounted therein.

4. An improved yard casting assembly as described in claim 3, wherein:

a) said lure skirt member includes a main connector ring mounted in said skirt connector groove portion and a plurality of trailing lure fingers connected to said main connector ring.

5. An improved yard casting assembly as described in claim 4, wherein:

a) said lure skirt member constructed of a resilient, flexible material for ease of mounting in said skirt connector groove portion and resembling live bait during a casting and retrieving operation.

6. An improved yard casting assembly operable with a casting rod and reel assembly having a fishing line, comprising:

a game target assembly having a lure connector member mounted thereon and projected forwardly therefrom;

b) a casting lure assembly connectable to the fishing line and engagable with said lure connector member in a locking action;

c) said lure connector member having a hook section of J-shape; and d) said casting lure assembly includes a main lure body member having a target connector section with a slot portion operable to receive said hook section therein in a locked condition when retrieving said game target assembly;

whereby a game operator of the casting rod and reel assembly can retrieve the fishing line and interconnected said casting lure assembly so as to engage said lure connector member and move said game target assembly to the game operator to simulate a fish catching operation.

7. An improved yard casting assembly operable with a casting rod and reel assembly having a fishing line in order to improve fishing skills of a game operator, comprising:

a) a game target assembly having 1) a main body member resembling an outline of an octopus structure; 2) a plurality of support legs connected to and extended laterally of the octopus structure; and 3) a lure connector member connected to each of said support legs;

b) a casting lure assembly connectable to the fishing line including a main lure body member with a forward connector section integral with a target connector section; and c) said target connector section having a slot portion operable to receive a respective one of said lure connector members therein in a locking action during a casting and retrieving operation.

8. An improved yard casting assembly as described in claim 7, wherein:

a) said main lure body member includes a skirt connector section integral with said target connector section having a lure skirt member mounted thereon;

b) said forward connector section includes a head portion connected to the fishing line; and c) said head portion integral with a sidewall portion of conical shape extended rearwardly and outwardly for ease of guidance into respective ones of said lure connector members in a casting and retrieving operation.

9. An improved yard casting assembly as described in claim 8, wherein:

a) said lure skirt member includes a connector ring releasably connected to said skirt connector section and a plurality of trailing lure fingers secured to said connector ring.

10. An improved yard casting assembly as described in claim 7, wherein:

a) each of said lure connector members are extended in vertical planes and includes a hook section of J-shape having a circular lure connector portion with a circumference greater than 180 degrees operable to receive said slot portion of said casting lure assembly therein.

11. An improved yard casting assembly as described in claim 7, wherein:

a) said game target assembly constructed of a water floatable material with said main body member and said support legs having lower surfaces in a common plane for floating in an upright condition on a body of water.

12. An improved yard casting assembly operable with a casting rod and reel assembly having a fishing line in order to improve fishing skills of a game operator, comprising:

a) a game target assembly having a main body member;

b) said main body member including a plurality of lure connector members each having a hook section of J-shape; and c) a casting lure assembly connectable to the fishing line and operable to be cast by the game operator using the casting rod and reel assembly and engaged with a respective one of said lure connector members;

whereby the game operator casts said casting lure assembly toward said game target assembly in order to place the fishing line within the confines of one of said lure connector members and retrieves the fishing line to place and lock said casting lure assembly within said lure connector member so that said game target assembly can be retrieved to the game operator similar to a fish catching operation.

13. An improved yard casting assembly as described in claim 12, wherein:

a) each of said lure connector members having said hook section extended in a vertical plane; and b) said hook section having an open area to receive the fishing line therethrough to guide said casting lure assembly into said hook section to a locked condition.

14. An improved yard casting assembly as described in claim 13, wherein:

a) said hook section includes a lure connector portion of circular shape in transverse cross section and having a circumference of greater than 180 degrees.

15. An improved yard casting assembly operable with a casting rod and reel assembly having a fishing line, comprising:

a) a game target assembly including a main base assembly having a lure connector member mounted thereon and projected therefrom; and b) said lure connector member includes a hook section being of J-shape and having an open "A" portion to allow the fishing line to move longitudinally and laterally of said lure connector member;

c) said hook section including a connector portion secured to said main base assembly and integral with a circular lure connector portion; and d) said open portion located between said connector portion and said lure connector portion.

16. An improved yard casting assembly as described in claim 15, wherein:

a) said circular lure connector portion shape having a circumference greater than 180 degrees and less than 270 degrees.

* * * * *